United States Patent [19]

Dan et al.

[11] Patent Number: 4,665,002

[45] Date of Patent: May 12, 1987

[54] LIQUID DEVELOPER FOR ELECTROSTATIC PHOTOGRAPHY

[75] Inventors: Shigeyuki Dan; Kazuo Ishii; Eiichi Kato; Hidefumi Sera, all of Kanagawa, Japan

[73] Assignee: Fuji Photo Film Co., Ltd., Kanagawa, Japan

[21] Appl. No.: 772,794

[22] Filed: Sep. 5, 1985

[30] Foreign Application Priority Data

Sep. 5, 1984 [JP] Japan ..... 59-186202

[51] Int. Cl.[4] ..... G03G 9/12

[52] U.S. Cl. ..... 430/114; 430/904

[58] Field of Search ..... 430/112, 113, 114, 115, 430/904

[56] References Cited

U.S. PATENT DOCUMENTS

| | | | |
|---|---|---|---|
| 3,554,946 | 1/1971 | Okuno et al. | 430/114 |
| 3,623,986 | 11/1971 | Machida et al. | 430/114 |
| 3,753,760 | 8/1973 | Kosel | 430/114 X |
| 3,883,440 | 5/1975 | Tamai et al. | 430/114 |

*Primary Examiner*—J. David Welsh

*Attorney, Agent, or Firm*—Sughrue, Mion, Zinn, Macpeak and Seas

[57] ABSTRACT

Disclosed is a liquid electrophotographic developer comprising a resin prepared by polymerizing selected monomers to provide a developer composition having good storage stability and redispersibility.

9 Claims, No Drawings

LIQUID DEVELOPER FOR ELECTROSTATIC PHOTOGRAPHY

FIELD OF THE INVENTION

The present invention relates to a liquid developer for electrostatic photography comprising at least a resin dispersed in a liquid carrier having an electric resistance of about $10^9$ Ω.cm or more and a dielectric constant of 3.5 or less, and, particularly, to a liquid developer having excellent redispersibility, storage property, stability, image reproduction and fixing property.

BACKGROUND OF THE INVENTION

Generally, electrophotographic liquid developers are those which are prepared by dispersing an organic or inorganic pigment or dye such as carbon black, Nigrosine, Phthalocyanine Blue, etc. and a natural or synthetic resin such as an alkyd resin, an acrylic resin, rosin, a synthetic rubber, etc. in a liquid with high electrical insulation property and low dielectric constant, such as a petroleum type aliphatic hydrocarbon, and adding a polarity controlling agent, such as a metal soap, lecithin, linseed oil, a higher aliphatic acid, polymers containing vinyl pyrrolidone, etc. In these developers, the resin is dispersed in the form of granule as insoluble latex grains such as a diameter of several μm to several hundred μm is obtained. In prior liquid developers, since the dispersion stabilizing soluble resin or the polarity controlling agent does not sufficiently bond to the insoluble latex grains, the dispersion stabilizing soluble resin and the polarity stabilizing agent can easily diffuse in the solution. Therefore, there is the disadvantage that the dispersion stabilizing soluble resin separates from the insoluble latex grains with precipitation, aggregation or accumulation of grains occurring or the polarity becomes obscure, when the developer is stored for a long time or is repeatedly used. Further, since it is difficult to disperse the grains again once they are aggregated or accumulated, the grains adhere to all parts of the developing apparatus to result in difficulties such as contamination of image parts or blockage of the liquid flow pump. In order to eliminate these disadvantages, the dispersion stabilizing soluble resin has been chemically bonded to the insoluble latex grains as disclosed in U.S. Pat. No. 3,990,980. However, according to experimental results of the present inventors, grains produced as described in U.S. Pat. No. 3,990,980 have the disadvantages that the particle size distribution curve has two or more peak values or the particle size distribution is broad and it is difficult to produce a uniform particle size and reproduction is not good. Generally, since the performance of liquid developers comprising dispersed resin grains, such as storage property, stability and image reproduction, is largely dependent on the particle size of the resin grains, a marked deterioration of performance occurs, if the particle size is not uniform.

SUMMARY OF THE INVENTION

The present invention provides an improvement in the above described disadvantages in the prior liquid developers for electrostatic photography.

Accordingly, an object of the present invention is to provide a liquid developer wherein redispersibility and stability do not deteriorate when it is stored for a long time or is repeatedly used.

Another object of the present invention is to provide a liquid developer having a uniform particle size and excellent image reproduction.

A further object of the present invention is to provide a liquid developer with which difficulties in the developing apparatus such as blockage of liquid flow pumps or image contamination do not occur, when it is repeatedly used for a long time.

A furthermore object of the present object of the present invention is to provide a liquid developer wherein the polarity of grains does not change and distinct images are always reproduced, even if the liquid developer is stored for a long time or is repeatedly used.

Accordingly, the present invention provides an electrostatic photography liquid developer comprising at least a resin dispersed in a liquid carrier, which has an electric resistance of about $10^9$ Ω.cm or more and a dielectric constant of about 3.5 or less, wherein the resin is one prepared by polymerizing a monomer (A) which is soluble in the liquid carrier but becomes insoluble on polymerization and at least one monomer (B) selected form the group consisting of monomers represented by the following formula (I) in the presence of at least one dispersion stabilizing resin soluble in the liquid carrier where the dispersion stabilizing resin is a copolymer prepared by reacting a copolymer prepared by polymerizing a monomer (C) selected from the group consisting of monomers represented by the following formula (II) and a monomer (D) selected from the group consisting of monomers represented by the formula (I) with a monomer (E) selected from the group consisting of monomers represented by the formula (II) to additionally introduce unsaturated bonds thereinto:

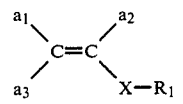

General Formula (I)

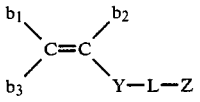

General Formula (II)

wherein X and Y which may be the same or different each represents —O—, —S—, —CO—, —$CO_2$—, —$SO_2$—, —OCO—, —CONH—, —$CONR_2$— where $R_2$ is a hydrocarbon group (preferably $C_1$ to $C_6$), —NHCO—, $NHCO_2$—, —NHCONH— or —$CH_2$—, or, if desired, Y is not present, $R_1$ represents a hydrocarbon group having 4 to 20 carbon atoms, Z represents —$CO_2H$,

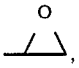

—COCl, —OH, —$NH_2$, —$NHR_3$ where $R_3$ is hydrocarbon group (preferably $C_1$ to $C_6$), or —NCO, L represents a hydrocarbon group (preferably $C_1$ to $C_6$) for bonding the atomic group Y to the atomic group Z, which may include a hetero atom through which the atomic group are bonded, or, if desired, L is not present, and $a_1$, $a_2$, $a_3$, $b_1$, $b_2$ and $b_3$, which may be the same or different, each represents a hydrogen atom, a hydrocarbon group (preferably $C_1$ to $C_3$), a carboxyl group or a carboxyl group containing a hydrocarbon group (preferably $C_1$ to $C_3$); wherein the monomer (B) and the monomer (D) selected from the same group of monomers may be the same or different each other, and the monomer (C) and the monomer (E) are different each other, which are selected from those wherein the Z moiety part in both of them can form a chemical bond.

DETAILED DESCRIPTION OF THE INVENTION

Suitable liquid carriers having an electric resistance of about $10^9$ Ω.cm or more and a dielectric constant of about 3.5 or less which can be used in the present invention include straight chain or branched chain aliphatic hydrocarbon (preferably $C_6$ to $C_{20}$), alicyclic hydrocarbons (preferably $C_6$ to $C_{20}$), aromatic hydrocarbons (preferably $C_6$ to $C_{20}$) and halogen substituted derivatives thereof. For example, octane, isooctane, decane, isodecane, decaline, nonane, dodecane, isododecane, Isopar E, Isopar G, Isopar H, Isopar L (Isopar: trade name of the Exxon Co.), Shellsol 70, Shellsol 71 (Shellsol: trade name of the Shell Oil Co.), AMSCO OMS, AMSCO 460 (AMSCO:trade name of the Sprit Co.), etc. are used alone or as a mixture thereof. The resin (insoluble latex grains) used in the present invention are produced by the so-called polymerization granulation process using a dispersion stabilizing soluble resin. The solvent used in this case can be any substance, as long as it is compatible with the above described liquid carrier, and it is possible to use straight chain or branched aliphatic hydrocarbons, alicyclic hydrocarbons, aromatic hydrocarbons and halogen substituted derivatives thereof. For example, octane, isooctane, decane, isodecane, decaline, nonane, dodecane, isododecane, Isopar E, Isopar G, Isopar H, Isopar L, Shellsol 70, Shellsol 71, AMSCO OMS, AMSCO 460, etc. can be used alone or as a mixture thereof. In order to obtain the insoluble latex grains in such a nonaqueous solvent in a stable manner, one or more kinds of dispersion stabilizing soluble resin synthesized from the above described monomers (C), (D) and (E) are used. The solvent used for synthesizing these resins is not particularly restricted. However, it is desirable to use a solvent which is compatible with the solvent used for polymerization granulation in order to use the resin in the subsequent polymerization granulation without removal of the solvent. For example, straight chain or branched chain aliphatic hydrocarbons, alicyclic hydrocarbons, aromatic hydrocarbons and halogen substituted derivatives thereof can be used alone or as a mixture thereof. Since the monomer (D) represented by the above described formula (I) provides the resin with solubility, it is desirable that the hydrocarbon group $R_2$ is such a group that the resin is easily compatible with the liquid carrier having an electric resistance of $10^9$ Ω.cm or more and a dielectric constant of 3.5 or less. For example, it is possible to use alkyl ester (where the alkyl group includes an octyl group, a decyl group, a dodecyl group, a tetradecyl group, a hexadecyl group, an octadecyl group and a 2-ethylhexyl group) of acrylic acid or methacrylic acid, and alkenyl esters (where the alkenyl group includes an octenyl group, a decenyl group, an octadecenyl group and an oleyl group) of acrylic acid or methacrylic acid. As the monomer (C) represented by the above described formula (II), it is possible to use unsaturated carboxylic acids (for example, acrylic acid, methacrylic acid, maleic acid, fumaric acid, crotonic acid, etc.) or chlorides thereof (for example, acrylic acid chloride, methacrylic acid chloride, crotonic acid chloride, etc.), unsaturated alcohols (for example, allyl alcohol, etc.), unsaturated amines (for example, allylamine, etc.), and glycidyl esters, hydroxypropyl esters or hydroxyethyl esters of acrylic acid or methacrylic acid, etc. As the monomer (E) represented by the above described formula (II), those examples given for the above described monomer (C) may be used, but it is necessary to select a monomer which is different from the monomer (C) and to select one wherein the moiety Z in the formula (II) is capable of easily forming a chemical bond by a reaction such as condensation or addition with the moiety Z of the monomer (C). For example, in case when a monomer wherein the moiety Z is $—CO_2H$ is used as the monomer (C), a monomer wherein the moiety Z is —OH,

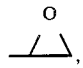

$—NH_2$ or $—NHR_3$ is selected for use as the monomer (E). Where the moiety Z of the monomer (C) is —OH, a monomer wherein the moiety Z is $—CO_2H$, —COCl or —NCO is selected for use as the monomer (E). In addition to these, various combinations, which can be easily selected in the field of organic chemistry, can be used.

In order to produce the unsaturated bond-containing soluble copolymer resins used in the present invention with the above described substances, the following procedure is carried out. The monomer (C) and the monomer (D) are dissolved in the above described solvent, and the mixture was heated at about 50° C. to about 200° C. for several hours in a presence of a polymerization initiator. Then, the monomer (E) and, if necessary, a known polymerization inhibitor conventionally used, are added and, if necessary, a catalyst such as lauryl dimethylamine, etc. is added depending on the nature of the reaction. The mixture is heated at the same temperature for several hours. In this case, the molar ratio of monomer (C) to monomer (D) is preferably in the range of about 50:50 to about 0.5:99.5, and the molar ratio of monomer (C) to monomer (E) is preferably in the range of about 2:3 to about 2:1. When a polymerization inhibitor is used, it is used in an amount of about 0.01 g to about 1 g per liter of the above described solvent. The unsaturated bond-containing copolymers obtained as described above have a molecular weight of about 5,000 to about 500,000. Examples of the dispersion stabilizing soluble resins which are the above described unsaturated bond-containing copolymers are described below, but the present invention is not to be construed as being limited thereto.

(i)
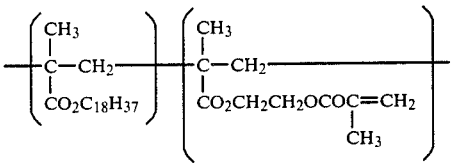
(ii)
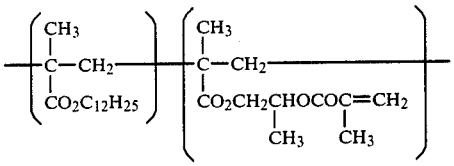
(iii)
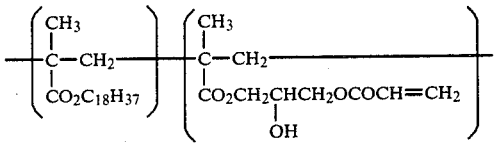
(iv)
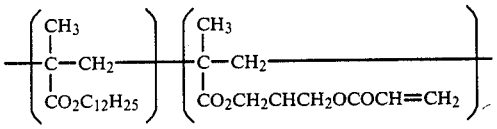
(v)
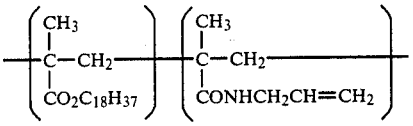
(vi)
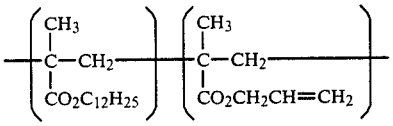
(vii)
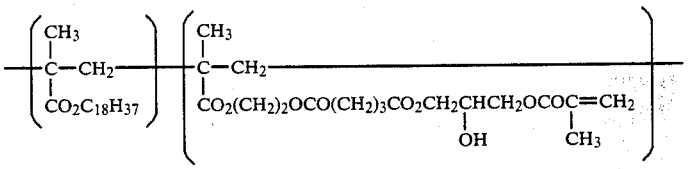
(viii)
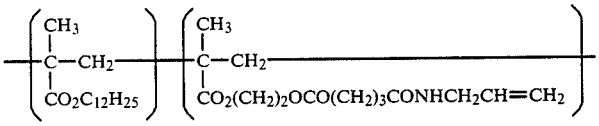
(ix)
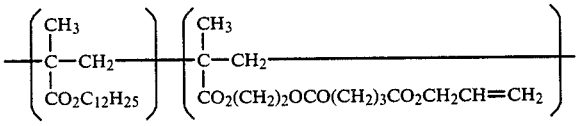
(x)
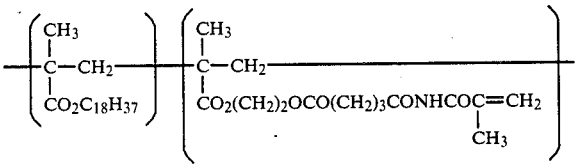

-continued (xi)

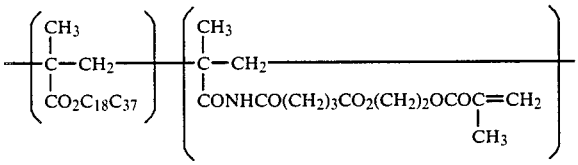

(xii)

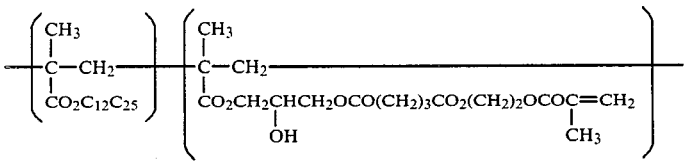

The process of producing the resin dispersion is illustrated below.

As the above described monomers (A), those which are soluble in the above described liquid carrier and the nonaqueous solvent but become insoluble in them upon polymerization are used. For example, it is possible to use alkyl esters of unsaturated carboxylic acids wherein the alkyl moiety has 1 to 3 carbon atoms such as acrylic acid, methacrylic acid, crotonic acid, itaconic acid, maleic acid, etc.; vinyl esters or allyl esters of aliphatic carboxylic acids having 1 to 3 carbon atoms; unsaturated carboxylic acids such as acrylic acid, methacrylic acid, crotonic acid, maleic acid, itaconic acid, etc. and anhydrides thereof; hydroxyethyl acrylate and methacrylate; N-vinylpyrrolidone, acrylonitrile, vinyl ether, etc.

The preferred examples of the monomer (A) include a substance represented by the following formula (III), itaconic anhydride, maleic anhydride, vinylpyrrolidone, and acrylonitrile;

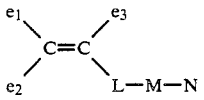

(III)

wherein $e_1$, $e_2$ and $e_3$, which may be the same or different, each represents a hydrogen atom, a hydrocarbon group having 1 to 4 carbon atoms, a carboxy group, or a carboxy group through a hydrocarbon group; L represents a hydrocarbon atom having 1 to 2 carbon atoms, or L represents a chemical bond; M represents $—CO_2—$, —OCO—, or —O—; and N represents a hydrogen atom, a hydrocarbon group having 1 to 3 carbon atoms, or a hydroxyl group through a hydrocarbon group.

As the above described monomers (B) represented by the formula (I), it is possible to use alkyl esters of acrylic acid and methacrylic acid wherein the alkyl moiety has 4 to 20 carbon atoms (where examples of suitable alkyl groups include an octyl group, a decyl group, a dodecyl group, a tetradecyl group, a hexadecyl group, octadecyl group and a 2-ethylhexyl group), alkenyl esters of acrylic acid and methacrylic acid (where examples of the alkenyl group include an octenyl group, a decenyl group, an octadecenyl group and an oleyl group), etc.

One or a mixture of two or more monomers (A), one or a mixture of two or more monomers (B) and one or a mixture of two or more unsaturated bond-containing copolymers obtained according to the above described process are dissolved in the above described nonaqueous solvent and heated at about 50° C. to about 200° C. for few hours in the presence of, if desired, a known polymerization initiator conventionally used in polymerization.

In this case, known dispersion stabilizers can be used together. Namely, various kinds of synthetic or natural resins soluble in the nonaqueous solvent can be used alone or as a mixture of two or more thereof. For example, polymers of monomers such as alkyl esters of acrylic or methacrylic acid having an alkyl chain having 4 to 30 carbon atoms (which may contain substituents such as halogen atoms, hydroxyl groups, amino groups, alkoxy groups, etc., or may have a hetero atom such as an oxygen atom, a nitrogen atom, or a sulfur atom, through which the carbon atoms in the main chain are bonded), vinyl esters of aliphatic acids, vinyl alkyl ethers or olefins such as butadiene, isoprene, diisobutylene, etc., copolymers of two or more of the above described monomers, and copolymers of the above described monomers forming polymers soluble in the nonaqueous solvent and one or more various monomers as described below, where the copolymers contain the following monomers in an amount such that they are soluble in the nonaqueous solvent. For example, vinyl acetate; methyl, ethyl, n-propyl and isopropyl esters of acrylic acid, methacrylic acid and crotonic acid; styrene derivatives such as styrene, vinyltoluene or α-methylstyrene; unsaturated carboxylic acids such as acrylic acid, methacrylic acid, crotonic acid, maleic acid or itaconic acid, and anhydrides thereof; and monomers having various kinds of polar groups such as a hydroxyl group, an amino group, an amide group, a cyano group, a sulfonic acid group, a carbonyl group, a halogen atom, a heterocyclic group, etc., such as hydroxyethyl methacrylate, hydroxyethyl acrylate, diethylaminoethyl methacrylate, N-vinylpyrrolidone, acrylamide, acrylonitrile, 2-chloroethyl methacrylate or 2,2,2-trifluoroethyl methacrylate. Further, in addition to the above described synthetic resins, it is possible to use natural resins such as alkyd resins, alkyd resins modified with various kinds of fatty acids, linseed oil, modified polyurethane resins, etc. As described, above one or more monomers (A) may be used, but the total amount of such is in the range of about 5 to about 80 parts by weight, preferably 10 to 50 parts by weight, based on 100 parts by weight of the above described nonaqueous solvent. Likewise, one or more monomers (B) may be used, but the total amount of such is in the range of about 0.1% to about 50% by mol, preferably 0.5% to 10% by mol, based on the total number of moles of monomers (A). The amount of the resins used for stabilizing dispersion is in the range of about 1 to about 100 parts by weight, preferably 5 to 50 parts by weight, based on 100 parts by weight of the total of the above described monomers (A). Where a polymerization initiator is used, it is preferred to use in an amount of about 0.1 to about 5 parts by weight based on 100 parts by weight of the total amount of monomers.

The nonaqueous dispersion type resins produced as described above have a uniform monodisperse particle size distribution and control to a desired particle size is easy. These disperse resins have very excellent redispersibility, stability and fixing properties. Precipitation, aggregation and contamination by adhesion to the container or parts of the developing apparatus do not occur, even if they are stored for a long time or are repeatedly used in the developing apparatus. Further, when fixation is carried out by heating or the like, a firm film is formed to produce an image having good durability. While not desiring to be bound, this remarkable improvement in performance is believed to be attained as a result of the following. Hitherto, nonaqueous dispersion type resins have had the disadvantage that the dispersion stabilizing soluble resin separates from insoluble latex grains resulting in a deterioration in performance, when the developer is stored for a long time or is repeatedly used. It has been already noted above that the process disclosed in U.S. Pat. No. 3,990,980, etc. was developed in order to improve the above described disadvantage. However, grains produced by the process disclosed in U.S. Pat. No. 3,990,980 have the disadvantage that the particle size distribution curve has two or more peaks or the width of the peak is broad and control to a uniform particle size is difficult and reproduction of these results is not good. Further, when these grains are stored for a long time or are representedly used, precipitation and aggregation occur resulting the inability for redispersion. Thus, a great improvement of performances is not observed as compared with the case of not using the process disclosed in U.S. Pat. No. 3,990,980. Accordingly, it is believed that, if the above described process is used, a rate of the part irreversibly bonding to the insoluble latex grains in the total amount of the dispersion stabilizing soluble resin used is small and the number of bonds in one grain is not uniform and is fairly one-sided with respect to the total amount of insoluble latex grains.

In the present invention, the insoluble latex grains are produced by further polymerizing the system disclosed in the U.S. Pat. No. 3,990,980 in a presence of a monomer rendering the resin soluble. Thus, it is surmized that several or several tens of monomers come into a polymerization activity part of the grain and a polymerization activity part of the dispersion stabilizing soluble resin to intermediate between them, when the dispersion stabilizing soluble resin is grafted on the grain.

In the present invention, if necessary, coloring agents may be used. Suitable coloring agents include various pigments and dyes known hitherto. The coloring agent may be used alone by dispersing such in the above described nonaqueous solvent with a dispersion accelerator or the like, or may be used as graft type grains (for example, Graft Carbon: trade name of Mitsubishi Gas Chemical Co.) wherein a polymer is chemically bonded to the surface of the coloring agent. The coloring agents used may be incorporated in the above described resin. A process for coloring the disperse resin is, for example, a process which comprises physically dispersing the coloring agent in the resin using a dispersing machine (e.g., a paint shaker, a colloid mill, a vibration mill, a ball mill, etc.) as described in Japanese Patent Application (OPI) No. 75242/73 (The term "OPI" as used herein refers to a "published unexamined Japanese patent application".) Quite a number of known pigments and dyes can be used. For example, magnetic iron oxide powder, carbon black, Nigrosine, Alkali Blue, Hansa Yellow, Quinacridone Red, Phthalocyanine Blue, Phthalocyanine Black, Benzidine Yellow, etc. can be used.

Another process for coloring is a process which comprises dyeing the disperse resin with a suitable dye by heating as described in Japanese Patent Application (OPI) No. 4873/82.

For example, Hansa Yellow, Crystal Violet, Victoria Blue, Malachite Green, Celliton Fast Red, Disperse Yellow, Disperse Red, Disperse Blue, Solvent Red, etc. can be used as colorants.

A further process for coloring is a process which comprises chemically bonding the disperse resin to a dye. For example, a process which comprises reacting a resin with a dye as described in Japanese Patent Application (OPI) No. 54029/78, and a process which comprises previously bonding a dye to a monomer of a resin which becomes insoluble and can be dispersed by polymerization, as described in Japanese Patent Publication No. 22955/69 (corresponding to British Pat. No. 1,181,287) can be used.

In order to enhance the electrical charging characteristics or to improve the image properties, various additives may be added, if desired, to the liquid developer of the present invention. They are described in, for example, Yuji Harazaki: *Denshishashin,* Vol. 16, No. 2, page 44.

For example, additives such as metal salts of di-2-ethylhexylsulfosuccinic acid, metal salts of naphthenic acid, metal salts of higher aliphatic acids, lecithin, poly(-vinylpyrrolidone), etc., can be used.

The amounts of each principal component in the liquid developer of the present invention are as follows.

The insoluble latex grains composed of a resin and a coloring agent as main ingredients preferably are in the range of about 0.5 parts by weight to about 50 parts by weight based on 1000 parts by weight of the liquid carrier. If the amount is less than 0.5 parts by weight, the image density is insufficient. If the amount is more than 50 parts by weight, fog easily occurs on the nonimage part. Resins soluble in the liquid carrier, such as the above described dispersion stabilizer, etc., are used as occasion demands, and they can be employed in the range of about 0.5 parts by weight to about 100 parts by weight based on 1000 parts by weight of the liquid carrier. The above described agents for controlling electric charge preferably are used in the range of about 0.001 to about 1.0 parts by weight based on 1000 parts by weight of the liquid carrier. If desired, other various additives may be added. The upper limit of the total amount of these additives is dependent on the electric resistance of the liquid developer. Namely, if electric resistance of the liquid developer without the insoluble latex grains is less than $10^9$ Ω.cm, continuous gradation image having good quality is difficult to obtain. Therefore, it is necessary to control the amount of each additive within the limit.

Embodiments of the present invention are exemplified below, but the present invention is not to be construed as being limited to these embodiments.

PRODUCTION EXAMPLE 1

Production of Dispersion Stabilizing Soluble Resin: Compound (i)

A mixture of 128.7 g of stearyl methacrylate, 2.6 g of 2-hydroxyethyl methacrylate and 240 g of toluene was heated to 75° C. in a nitrogen stream, and 1.3 g of azobisisobutyronitrile was added thereto with stirring. After 6 hours, a Dean-Stark water separator was attached to a reactor, and 0.2 g of hydroquinone, 0.1 g of conc. sulfuric acid and 1.7 g of methacrylic acid were added. The temperature was raised to 110° C. with stirring, and the reaction was carried out until 65% of the methacrylic acid was consumed. After the reaction was completed, the reaction solution was poured into 4,000 g of methanol and purified reprecipitation. Thus, a slightly yellowish powder was obtained. When the average molecular weight of the powder of the resulted substance was measured by a high speed liquid chromatographic method, it was $17.8\times10^4$.

PRODUCTION EXAMPLE 2

Production of Dispersion Stabilizing Soluble Resin: Compound (ii)

A mixture of 93.6 g of lauryl methacrylate, 4.5 g of glycidyl methacrylate and 230 g of toluene was heated to 85° C. in a nitrogen stream, and 1.0 g of benzoyl peroxide was added thereto with stirring. After 4 hours, the temperature was reduced to 40° C., and 0.2 g of hydroquinone, 0.2 g of lauryl dimethylamine and 2.8 g of methacrylic acid were added thereto. The temperature was raised to 115° C. with stirring, and the reaction was carried out until 55% of the methacrylic acid added was used up. After the reaction, the reaction solution was poured into 4,000 g of methanol and purified by reprecipitation. Thus, a brown viscous product was obtained. The average molecular weight measured in the same manner as in Production Example 1 was $15.0\times10^4$.

PRODUCTION EXAMPLE 3

Production of Dispersion Stabilizing Soluble Resin: Compound (iii)

A mixture of 130 g of stearyl methacrylate, 1.4 g of methacrylic acid and 240 g of toluene was heated to 85° C. in a nitrogen stream, and 1.3 g of benzoyl peroxide was added thereto with stirring. After 4 hours the temperature was reduced to 40° C., and 0.2 g of hydroquinone, 0.2 g of lauryl dimethylamine and 2.0 g of glycidyl acrylate were added thereto. The temperature was raised to 115° C. with stirring, and the reaction was carried out until 55% of methacrylic acid used was used up. After the reaction, the reaction solution was poured into 4,000 g of methanol and purified by reprecipitation. Thus, a slightly yellowish powder was obtained. The average molecular weight was $21.3\times10^4$.

PRODUCTION EXAMPLE 4

Production of Dispersion Stabilizing Soluble Resin: Compound (iv)

The same procedure as in Production Example 3 was carried out using 97.7 g of lauryl methacrylate instead of stearyl methacrylate in Production Example 3 to obtain a slightly brownish viscous product. The average molecular weight was $18.7\times10^4$.

PRODUCTION EXAMPLE 5

Production of Dispersion Stabilizing Soluble Resin: Compound (v)

A mixture of 121.9 g of stearyl methacrylate, 4.2 g of methacrylic acid chloride and 300 g of toluene was heated to 75° C. in a nitrogen stream, and 1.2 g of azobisisobutyronitrile was added with stirring. After 6 hours, 0.2 g of hydroquinone and 2.3 g of allylamine were added thereto. The temperature was raised with stirring until the reaction solution slowly refluxed, and the reaction was carried out for 6 hours under reflux. After the reaction, the reaction solution was poured into 4,000 g of methanol and purified by reprecipitation. Thus, a white power was obtained. The average molecular weight was $24.7\times10^4$.

PRODUCTION EXAMPLE 6

Production of Dispersion Stabilizing Soluble Resin: Compound (vi)

The same procedure as in Production Example 5 was carried out using 91.6 g of lauryl methacrylate instead of stearyl methacrylate used in Production Example 5 and 2.3 g of allyl alcohol instead of allylamine to obtain slightly brownish viscous product. The average molecular weight was $12.8\times10^4$.

PRODUCTION EXAMPLE 7

Production of Dispersion Stablizing Soluble Resin: Compound (vii)

A mixture of 28.5 g of glutaric acid anhydride, 32.5 g of 2-hydroxyethyl methacrylate, 0.5 ml of conc. sulfuric acid and 50 ml of benzene was stirred at room temperature (about 20°-30° C.). After 30 minutes, heat was generated. The stirring was continued for 2 hours with spontaneous refluxing. After the reaction solution was washed with water and dried, the solvent was removed under reduced pressure. The product was nearly pure, and if necessary, it may be purified by silica gel column chromatography. A mixture of 8.8 g of the resulting monomer as described above, 123.2 g of stearyl methacrylate and 240 g of toluene was heated to 75° C. in a nitrogen stream, and 1.2 g of azobisisobutyronitrile was added with stirring. After 6 hours, 0.2 g of hydroquinone, 0.2 g of lauryl dimethylamine and 5.1 g of glycidyl methacrylate were added thereto. The temperature was raised to 110° C. with stirring, and the reaction was carried out until 70% of the carboxylic acid derived from the monomer used was consumed. After the reaction, the reaction solution was poured into 4,000 g of methanol and porified by reprecipitation. Thus, a white powder was obtained. The average molecular weight was $28.7\times10^4$.

PRODUCTION EXAMPLE 8

Production of Dispersion Stabilizing Soluble Resin: Compound (viii)

The same procedures as in Production Example 7 were carried out using 92.6 g of lauryl methacrylate instead of stearyl methacrylate used in Production Example 7, 2.1 g of allylamine instead of glycidyl methacrylate, and 0.1 g of sulfuric acid instead of lauryl dimethylamine, to obtain a colorless transparent viscous product. The average molecular weight was $25.3\times10^4$.

PRODUCTION EXAMPLE 9

Production of Dispersion Stabilizing Soluble Resin: Compound (ix)

The same procedures as in Production Example 8 were carried out using 5.1 g of glycidyl methacrylate instead of allylamine used in Production Example 8, and 0.2 g of lauryl dimethylamine instead of sulfuric acid, to obtain a slightly brownish viscous product. The average molecular weight was $28.0\times10^4$.

PRODUCTION EXAMPLE 10

Production of Resin Grains

A mixture of 11.7 of the resin obtained in Production Example 1 above, 90 g of vinyl acetate, 13.3 g of lauryl methacrylate and 360 g of Isopar H was heated to 70° C. in a nitrogen stream, and 1 g of azobisisobutyronitrile was added with stirring. After 1 hour, the reaction solution became cloudy and the temperature rose to 84° C. After 2 hours, 0.5 g of azobisisobutyronitrile was additionally added and the reaction was carried out for 2 hours additionally. A white dispersion obtained by passing through a 200 mesh cloth after cooling was a latex having a polymerization rate of 87% and an average particle size of 0.07 μm.

PRODUCTION EXAMPLE 11

Production of Resin Grains

A mixture of 7.2 g of the resin obtained in Production Example 3 above, 60 g of vinyl acetate, 2.4 g of stearyl methacrylate and 240 g of Isopar H was heated to 70° C. in a nitrogen stream, and 0.7 g of azobisisobutyronitrile was added with stirring. After 40 minutes, the reaction solution became cloudy and the temperature rose to 90° C. After 2 hours, 0.3 g of azobisisobutyronitrile was additionally added and the reaction was carried out for 2 hours additionally. A white dispersion obtained by passing through a 200 mesh cloth after cooling was a latex having a polymerization rate of 88% and an average particle size of 0.18 μm.

PRODUCTION EXAMPLE 12

Production of Resin Grains

A mixture of 7 g of the resin obtained in Production Example 4 above, 50 g of vinyl acetate, 1.3 g of lauryl methacrylate and 200 g of Isopar H was heated to 75° C. in a nitrogen stream, and 0.8 g of azobisisobutyronitrile was added with stirring. After 15 minutes, the reaction solution became cloudy and the temperature rose to 85° C. After 2 hours, 0.4 g of azobisisobutyronitrile was additionally added and the reaction was carried out for 1 hour additionally. A white dispersion obtained by passing through a 200 mesh cloth after cooling was latex having a polymerization rate of 88% and an average particle size of 0.11 μm.

PRODUCTION EXAMPLE 13

Production of Resin Grains

The same procedures as in Production Example 12 above were carried out except that the amount of lauryl methacrylate used in Production Example 12 was increased to 4.5 g. The resulting white dispersion was a latex having a polyermization rate of 81% and an average particle size of 0.09 μm.

PRODUCTION EXAMPLE 14

Production of Resin Grains

A mixture of 9.1 g of the resin obtained in Production Example 5 above, 65 g of vinyl acetate, 5.1 g of stearyl methacrylate and 260 g of Isopar H was heated to 75° C. in a nitrogen stream, and 0.7 g of azobisisobutyronitrile was added with stirring. After 40 minutes, the reaction solution became cloudy and the temperature rose to 85° C. After 2 hours, 0.3 g of azobisisobutyronitrile was additionally added and the reaction was carried out for 2 hours additionally. A white dispersion obtained by passing through a 200 mesh cloth after cooling was a latex having a polymerization rate of 82% and an average particle size of 0.10 μm.

PRODUCTION EXAMPLE 15

Production of Resin Grains

A mixture of 8.3 g of the resin obtained in Production Example 6 above, 75 g of vinyl acetate, 2 g of lauryl methacrylate and 300 g of Isopar G was heated to 70° C. in a nitrogen stream, and 0.8 g of azobisisobutyronitrile was added with stirring. After 20 minutes, the reaction solution became cloudy and the temperature rose to 90° C. After 2 hours, 0.4 g of azobisisobutyronitrile was additionally added and the reaction was carried out for 2 hours further. A white dispersion obtained by passing through a 200 mesh cloth after cooling was a latex having a polymerization rate of 88% and an average particle size of 0.11 μm.

PRODUCTION EXAMPLE 16

Production of Resin Grains

A mixture of 13 g of the resin obtained in Production Example 7 above, 65 g of vinyl acetate, 10 g of stearyl methacrylate and 360 g of Isopar G was heated to 80° C. in a nitrogen stream, and 0.5 g of benzoyl peroxide was added with stirring. After 1 hour, the reaction solution became cloudy and the temperature rose to 90° C. After 3 hours, 0.3 g of benzoyl peroxide was additionally added and the reaction was carried out for 2 hours further. A white dispersion obtained by passing through a 200 mesh cloth after cooling was a latex having a polymerization rate of 79% and an average particle size of 0.09 μm.

PRODUCTION EXAMPLE 17

Production of Resin Grains

The same procedures as in Production Example 16 above were carried out using 7.5 g of lauryl methacrylate instead of stearyl methacrylate used in Production Example 16. The resulting white dispersion was a latex having a polymerization rate of 78% and an average particle size of 0.08 μm.

PRODUCTION EXAMPLE 18

Production of Resin Grains

A mixture solution of 9.8 g of the resin obtained in Production Example 8 above, 75 g of vinyl acetate, 2.2 g of lauryl methacrylate and 225 g of Isopar G was heated to 70° C. in a nitrogen stream, and 0.8 g of azobisisobutyronitrile was added with stirring. After 30 minutes, the reaction solution became cloudy and the temperature rose to 85° C. After 2 hours, 0.4 g of azobisisobutyronitrile was additionally added and the reaction was carried out for 2 hours additionally. A white dispersion obtained by passing through a 200 mesh cloth after cooling was a latex having a polymerization rate of 87% and an average particle size of 0.10 μm.

PRODUCTION EXAMPLE 19

Production of Resin Grains: Comparative Example A - 1

The same procedures as in Production Example 12 above was carried out using a mixture of 7 g of the resin obtained in the Production Example 4 above, 50 g of vinyl acetate and 200 g of Isopar H. The resulting white dispersion was a latex having a polymerization rate of 89%, but the average particle size of the latex had two peaks with relative intensities of 17% and 8% at 1.04 μm and 0.24 μm, respectively.

PRODUCTION EXAMPLE 20

Production of Resin Grains: Comparative Example A - 2

When the same procedures as in Production Example 19 above was repeated, the resulting white dispersion was a latex having a polymerization rate of 90%, wherein the average particle size of the latex had three peaks with relative intensities of 17%, 7% and 13% at 2.00 μm, 1.30 μm and 0.30 μm, respectively.

PRODUCTION EXAMPLE 21

Production of Resin Grains: Comparative Example B - 1

The same procedures as in Production Example 16 was carried out using a mixture of 13 g of the resin obtained in Production Example 7 above, 65 g of vinyl acetate and 360 g of Isopar G. The resulting white dispersion was a latex having a polymerization rate of 87%, but the average particle size of the latex had two peaks with relative intensities of 20% and 4% in 1.52 μm and 0.32 μm, respectively.

PRODUCTION EXAMPLE 22

Production of Resin Grains: Comparative Example B - 2

When the same procedures as in Production Example 21 above was repeated, the resulting white dispersion was a latex having a polymerization rate of 88%, wherein the average particle size of the latex had two peaks having relative intensities of 10% and 25% in 1.20 μm and 0.26 μm, respectively.

EXAMPLE 1

20 g of polylauryl methacrylate, 20 g of Nigrosine and 30 g of Isopar G were processed by a ball mill for 6 hours to obtain a finely dispersed Nigrosine dispersion. 40 g of the resin dispersion in Production Example 10, 30 g of the Nigrosine dispersion and 0.06 g of zirconium naphthenate were diluted with 2l of Isopar G to produce a liquid developer.

(Comparative Developers A and B)

Two liquid developers A and B for comparison were produced using the following resin grains instead of resin dispersion in the above described example.

Comparative Liquid Developer A: Resin dispersion in Production Example 19

Comparative Liquid Developer B: Resin dispersion in Production Example 21

The resulting liquid developers were used as developers for a Fuji automatic plate making apparatus ELP 280 (made by Fuji Photo Film Co., Ltd.). As electrophotographic light-sensitive materials for printing masters, ELP masters (made by Fuji Photo Film Co., Ltd.) were used, and master plates were obtained by forming an image on the ELP masters with a positive original having a continuous gradation. The resulting image on the master plates had good quality. Likewise, 2,000 sheets of ELP master were processed. Thereafter, the presence of toner adhered to the developing apparatus was examined. As the result, contamination did not occur at all in case of using the developer comprising the resin of the present invention (Production Example 10), while contamination due to adhesion greatly occurred around the periphery of the rollers and the periphery of the development electrodes in using Comparative Liquid Developers A and B. Further, in the master plates for offset printing obtained with the developer of the present invention, both the initially developed plate and the plate after developing 2,000 plates had a very clear image. When printing was carried out by a conventional method using these master plates, a clear print could be obtained after printed 3,000 sheets. Further, when the same processing as described above was carried out after this developer was allowed to stand for 3 months, the result was not different from the case of using fresh developer.

EXAMPLE 2

A mixture of 100 g of the white dispersion obtained in Production Example 11 and 1.5 g of Sumikaron Black was heated to 100° C. and stirred with heating for 4 hours. After cooling to room temperature, it was filtered through a 200 mesh nylon cloth and residual dye was removed to obtain a black resin dispersion having an average particle size of 0.19 μm.

30 g of the above described resin dispersion and 0.05 g of zirconium naphthenate were diluted with 1l of Shellsol 71 to produce a liquid developer.

When development was carried out using this developer with the same apparatus as in Example 1, contamination by adhesion of the toner to the apparatus did not occur at all even after 2,000 plates were developed.

EXAMPLE 3

A mixture of 100 g of the white dispersion obtained in Production Example 12 and 3 g of Victoria Blue B was heated to 70°-80° C. and stirred for 6 hours. After cooling to room temperature, it was filtered through a 200 mesh nylon cloth and residual dye was removed to obtain a blue resin dispersion having an averge particle size of 0.12 μm. 28 g of the above described blue resin dispersion and 0.05 g of zirconium naphthenate were diluted with 1 l of Isopar H to produce a liquid developer.

When development was carried out using this developer with same apparatus as in Example 1, contamination by adhesion of the toner to the apparatus was not observed at all even after developing 2,000 plates. The image on the resulting master plates for offset printing was distinct and the print image after printing 3,000 sheets was very distinct.

EXAMPLE 4

30 g of the white resin dispersion obtained in Production Example 16, 2.5 g of the Nigrosine dispersion obtained in Example 1 and 0.02 g of a semidocosanylamide of diisobutylenemaleic acid anhydride copolymer were diluted with 1l of Isopar G to produce a liquid developer.

When development was carried out using this developer with same apparatus as in Example 1, contamination by adhesion of the toner to the apparatus was not observed at all even after developing 2,000 plates. The image on the resulting master plates for offset printing and the print image after printing 3,000 sheets were both distinct.

Further, when the same processing as described above was carried out after this developer was allowed to stand for 3 months, the result was not different from the case of fresh developer.

While this invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising at least a resin dispersed in a liquid carrier having an electric resistance of about $10^9\Omega$.cm or more and a dielectric constant of about 3.5 or less, wherein the resin is prepared by polymerizing a monomer (A) which is soluble in said liquid carrier but becomes insoluble upon polymerization and at least one monomer (B) selected from the group consisting of monomers represented by the following formula (I) in a presence of at least one dispersion stabilizing resin soluble in said liquid carrier which is a copolymer prepared by reacting a copolymer prepared by polymerizing a monomer (C) selected from the group consisting of monomers represented by the following formula (II) and a monomer (D) selected from the group consisting of monomers represented by the formula (I) with a monomer (E) selected from the group consisting of monomers represented by the formula (II) to additionally introduce unsaturated bonds:

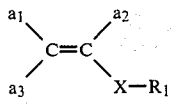

(I)

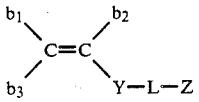

(II)

wherein X and Y, which may be the same or different, each represents —O—, —S—, —CO—, —$CO_2$—, —$SO_2$—, —OCO—, —CONH—, —$CONR_2$— where $R_2$ is a hydrocarbon group, —NHCO—, —$NHCO_2$—, —NHCONH— or —$CH_2$—, or Y is not present, and $R_1$ represents a hydrocarbon group having 4 to 20 carbon atoms, z represents —$CO_2H$,

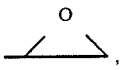

—COCl, —OH, —$NH_2$, —$NHR_3$ where $R_3$ is a hydrocarbon group, or —NCO, L represents a hydrocarbon group for bonding the atomic group Y to the atomic group Z, which may have a hetero atom through which said atomic groups are bonded, or L is not present, and $a_1$, $a_2$, $a_3$, $b_1$, $b_2$ and $b_3$, which may be the same or different, each represents a hydrogen atom, a hydrocarbon group, a carboxyl group or a carboxyl group containing a hydrocarbon group, wherein the monomer (B) and the monomer (D) selected from the same group of monomers may be the same or different, and the monomer (C) and the monomer (E) are different from each other, which are selected from those wherein the Z moiety in both of them forms a chemical bond, the molar ratio of monomer (C) to monomer (D) is about 50:50 to about 0.5:99.5 and the molar ratio of monomer (C) to monomer (E) is about 2:3 to about 2:1, the amount of said dispersion stabilizing resin is in the range of about 1 to about 100 parts of weight, based on 100 parts by weight of the total of the monomers (A), and the total amount of the monomers (B) is in the range of about 0.1% to about 50% by mol based on the total number of moles of monomers (A).

2. The liquid developer as claimed in claim 1, wherein said liquid carrier is a straight chain or branched chain aliphatic hydrocarbon, alicyclic hydrocarbon, an aromatic hydrocarbon or a halogen substituted derivative thereof.

3. The liquid developer as claimed in claim 1, wherein the molecular weight of the dispersion stabilizing resin is about 5,000 to about 500,000.

4. The liquid developer as claimed in claim 1, wherein said monomer (A) is selected from a substance represented by the following formula (III), itaconic anhydride, maleic anhydride, vinylpyrrolidone, and acrylonitrile;

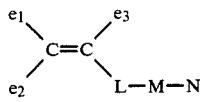

(III)

wherein $e_1$, $e_2$ and $e_3$, which may be the same or different, each represents a hydrogen atom, a hydrocarbon group having 1 to 4 carbon atoms, a carboxy group, or a carboxy group through a hydrocarbon group; L represents a hydrocarbon atom having 1 to 2 carbon atoms, or L represents a chemical bond; M represents —$CO_2$—, —OCO—, or —O—; and N represents a hydrogen atom, a hydrocarbon group having 1 to 3 carbon atoms, or a hydroxyl group through a hydrocarbon group.

5. The liquid developer as claimed in claim 1, wherein the total amount of the monomers (B) is in the range of 0.5 to 10% by mol based on the total number of moles of monomers (A).

6. The liquid developer as claimed in claim 1, wherein said resin is in the range of about 0.5 to about 50 parts by weight based on 1,000 parts by weight of the liquid carrier.

7. The liquid developer as claimed in claim 1, wherein said developer further contains a coloring agent.

8. The liquid developer as claimed in claim 1, wherein said developer further contains an agent for controlling electric charge.

9. The liquid developer as claimed in claim 8, wherein said agent for controlling electric charge is selected from the group consisting of metal salts of di-2-ethylhexylsulfosuccinic acid, metal salts of naphthenic acid, metal salts of higher aliphatic acids, lecithin and poly(vinylpyrrolidone).

* * * * *